United States Patent [19]

Maier

[11] Patent Number: 4,756,271

[45] Date of Patent: Jul. 12, 1988

[54] COATING DIE

[75] Inventor: Gary W. Maier, Warren Township, St. Croix County, Wis.

[73] Assignee: Minnesota Mining and Manufacturing Company, St. Paul, Minn.

[21] Appl. No.: 5,623

[22] Filed: Jan. 21, 1987

[51] Int. Cl.[4] ..... B05C 5/02

[52] U.S. Cl. ..... 118/411; 118/415; 118/25; 222/144.5; 222/485

[58] Field of Search ..... 118/25, 410, 411, 415; 222/144.5, 485, 487

[56] References Cited

U.S. PATENT DOCUMENTS

| | | | |
|---|---|---|---|
| 3,052,565 | 9/1962 | Chinn et al. | 118/411 X |
| 3,342,145 | 9/1967 | Brunson | 118/25 X |
| 3,642,181 | 2/1972 | Thomas et al. | 118/410 X |

*Primary Examiner*—John P. McIntosh

*Attorney, Agent, or Firm*—Donald M. Sell; John C. Barnes

[57] ABSTRACT

A coating die is adapted to apply a number of materials onto a web from a single coating slot by the use of a movable cam in the die to alternately connect the coating slot to one or the other of a pair of inlet ports and seal the other port. A rotary cam facilitates rapid change of materials from the coating slot onto a continuously moving web.

8 Claims, 4 Drawing Sheets

COATING DIE

BACKGROUND OF THE INVENTION

Field of the Invention

This invention relates to an improvement in a pressure fed coating die, and in one aspoect, to an improved multicomponent coating die which will afford the coating of different materials successively lengthwise on a web without interrupting movement of the web.

It has been desirable in the past to be able to coat a strip or coat a product in the machine direction of a moving web and then to either interrupt the coating or to apply a different coating to the web down stream from the first coating in the same general area on the web. Such systems have required, however, the interruption of the coater and a changing of the material in the coating die to be able to apply the next coating. The present invention provides an improved multi-material pressure fed coating die which will permit the application of two different compositions in the same down web stripe, multiple cross web stripes in multiple compositions in the down web direction, and intermittent stripes of the same of different compositions.

SUMMARY OF THE INVENTION

The present invention is directed to an improved coating die which can create onto a moving web a stripe with the material in the sripe being interrupted abruptly during web movement or switches to a second position to apply a different composition onto the web.

The die compries a die body having a cavity defining a fluid chamber which communicates with inlet ports and with a coating die opening or slot. An internal cam is positioned in the fluid chamber and is movable between positions to provide communication between a first of the inlet ports and the coating die opening or a second inlet port and the coating die opening.

The internal cam comprises a movable cam member formed with at least a pair of manifolds and movable within the fluid chamber to communicate one manifold or the other manifold with the coating opening. Means are provided for moving the cam to place either manifold in communication with the coating die opening and the other manifold may communicate between a supply or inlet port and a bypass or outlet port. Each supply port is connected to a source of fluid being coated onto the moving web. Frequency of movement of the cam to one or the other of its positions to place one of the other of the manifolds in communication with the coating die is determined by web speed and length of the stripe desired of any particular coating material.

A plurality of coating die openings or slots may be formed in the die body longitudinally of the die and a plurality of separate individual manifolds can be formed into the cam along the length of one cam or in separate cams such that a variety of materials can be dispensed along the length of the web along transversely spaced paths.

BRIEF DESCRIPTION OF THE DRAWING

The present invention will be further described with reference to the accompanying drawing wherein.

DETAILED DESCRIPTION

The coating die of the present invention permits a single coating composition to be interrupted abruptly or multiple compositions to be applied successively along a moving web in the same coating area or multiple stripes of separate coating materials transversely of a web and along the length of the web.

Figure 1:
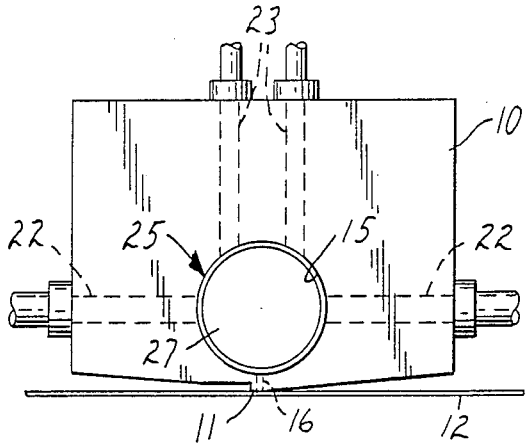
FIG. 1 is an end view of a coating die body constructed according to the present invention.

FIG. 1 discloses an end view of the die having a block shaped die body 10 formed with an external lower coating surface 11 across which a web 12 is drawn to receive onto that web various materials. The body 10 is formed with two projections 13 at one end and a transversely extending cylindrical bore 15 forming a fluid chamber in the body. The chamber 15 communicates with a slotted coating orifice 16 formed in the face 11 of the die body 10 from which the coating material or composition can flow to coat the web 12. The orifice 16 may comprise a single orifice or spaced orifices along the transverse dimension of the die, depending on the number of stripes to be applied to the web. As illustrated the orifice 16 is a thin slot. A plurality of inlet ports 22 are directed from the side walls of the coating die body into communication with the chamber 15 and a series of exit or outlet ports 23 communicate with the chamber and the upper surface of the body 10. The inlet openings each communicate with a constant displacement metering pump (not shown) to assure precision coating weight control for the solution to be coated from an orifice 16 onto the web 12.

Figure 2:
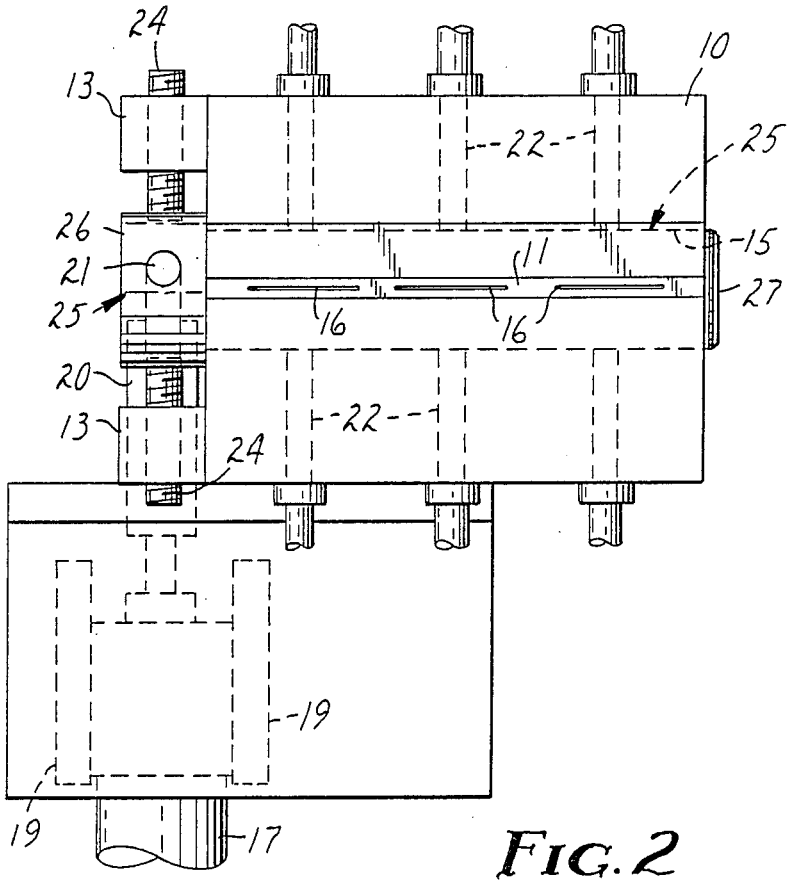
FIG. 2 is a bottom view of the assembled coating die of the present invention.
Figure 3:
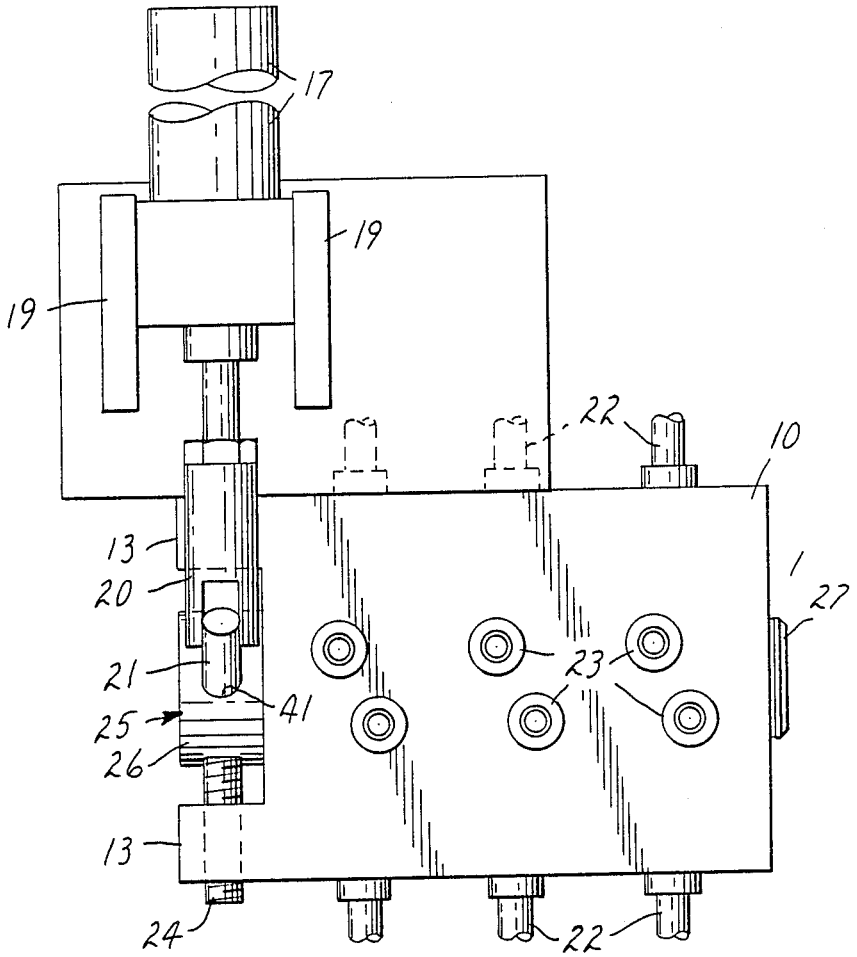
FIG. 3 is a top plan view of the coating die.
Figure 5:
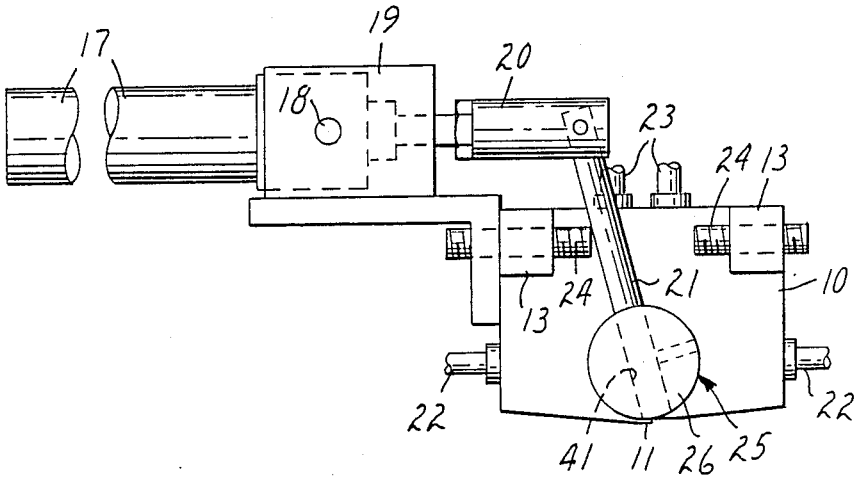
FIG. 5 is an end view of the assembled coating die.
Figure 6:
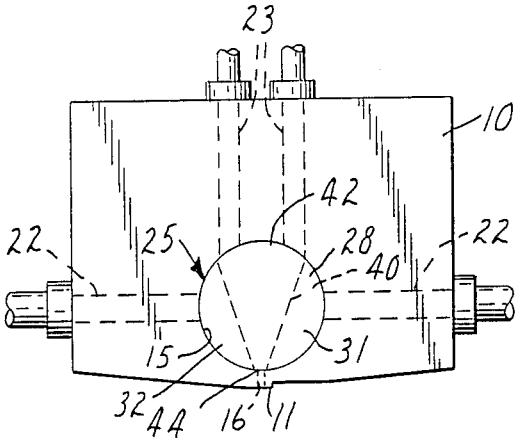
FIG. 6 is a diagrammatic illustration of an end view of the coating die.
Figure 7:
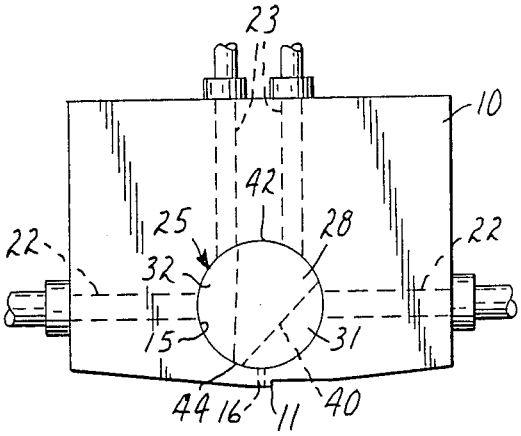
FIG. 7 is a second diagrammatic view of the coating die of the present invention.

As shown in FIGS. 2 and 5, an operator is used to control the position of a cam 25 disposed in the fluid chamber 15. The cam 25 is disclosed in FIG. 9 and described below. The operator comprises a double acting fluid cylinder 17 pivoted on trunnions 18 which are journalled in a bracket 19. The piston rod of the cylinder 17 is fixed to a clevis 20 which is coupled by a pin to a radial arm 21 extending diametrically through one end of the cam 25 and held by a set screw. Operation of the cylinder 17 will oscillate the arm 21 and cam 25 through an arc defined by adjustable stops 24 threaded through projections 13. Various mounting brackets are shown to support the cylinder 17 on the die body 10 and the assembled coating die adjacent the web transport.

Figure 9:
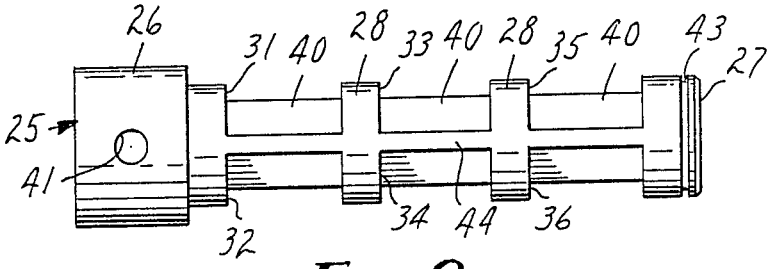
FIG. 9 is a detailed view of a cam for the coating die as illustrated in FIGS. 1–4.
Figure 4:
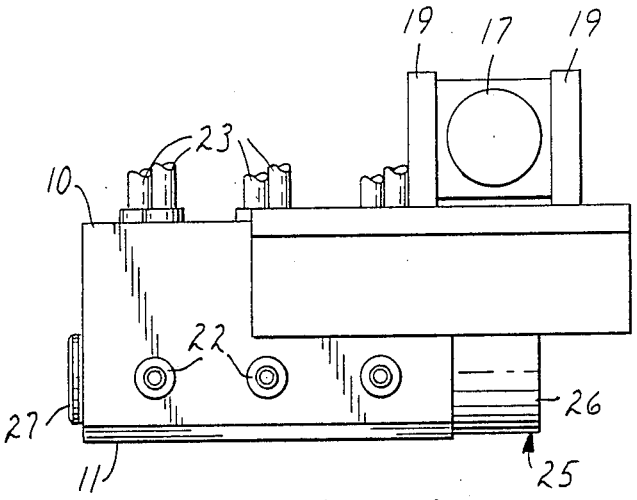
FIG. 4 is a side elevation view of the coating die.

As shown in FIG. 9, the cam 25 has ends 26 and 27 which conform to and rotatably fit within the chamber 15. The end 26 has a portion of greater diameter than the chamber 15 to restrict axial movement of the cam in one direction. Between the ends of the cam may be formed coaxial baffles 28 which separate cut out areas forming pairs of manifolds 31–32, 33–34, and 35–36 on opposite sides of the axis of the cam 25. The cam 25 thus has a pair of manifolds adapted to communicate with each coating slot 16, which manifolds are separated by a partition 40 formed by walls along chords of the elongate cylindrical die cam. Each partition 40 separates a pair of manifolds and extends from the circular periphery on one side of the axis to the periphery on the opposite side forming two land areas 42 and 44. The land area 42 can close one or the other of the spaced bypass ports 23. The land area 44 can close the coating slot 16 or afford communication between one manifold and the coating slot 16. The land area 44 will seal the one manifold from the coating slot and the land area 42 will allow free communication of said one manifold with a recirculating bypass port 23. Rotation of the cam 25 about its axis then reverses the position of the cam to connect the other of the manifolds with the die orifice 16 and connect the first manifold with the bypass port 23. The land areas 42 and 44 may follow a helical path along the length of the cam, be staggered circumferentially, or have other positions with respect to the coating openings.

The cam end 26 has a hole 41 to receive the arm 21 and the end 27 has a peripheral groove 43 to receive a retaining clip or washer to retain the cam against axial displacement.

Figure 8:
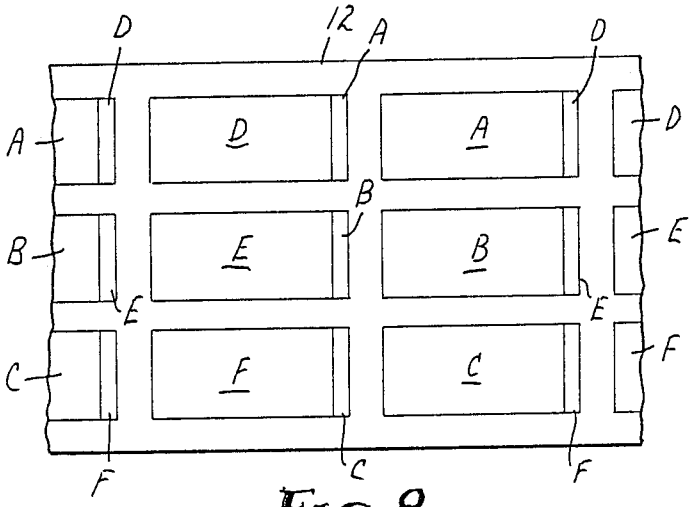
FIG. 8 is a plan view of a web coated with the coating die.

The die illustrated in the drawings comprises three coating orifices 16 positioned transversely of the web 12 and six manifolds in the cam. Each of the inlet openings 22 can be connected to a separate coating composition to permit six different coating compositions to be coated along the length of the web with three of the coatings being applied simultaneously as illustrated in FIG. 8. As illustrated therein, coatings A, B, and C can be applied and then the cam 25 is rotated during continued web movement to apply coatings D, E, and F. Only residual amounts of coatings A, B, and C would appear in the areas of coatings D, E, and F because of the residual material left in the coating slot 16 between the fluid chamber and the position where the slot communicates with the surface 11 on the die body 10.

The cam and die body illustrated has three coating slots whereas there could alternatively be one with a pair of manifolds, or the cam could be divided at a baffle 28 and each end of the cam could rotate independently to increase the number of patterns of coating materials which could be applied to a web.

The die body illustrated has the surface 11 within 0.060 inch of the fluid chamber 15 and the slots have a width in the web direction of 0.010 inch. The shape, length, and spacing between coating openings can vary.

Having described a preferred embodiment it is to be understood that variations other than those mentioned could be made without departing from the scope of the invention as claimed in the dependent claims.

I claim:

1. A die comprising a die body having a coating orifice, means in said die body for defining a fluid chamber communicating with said coating orifice, means defining a pair of inlet ports to said fluid chamber, and cam means disposed in said fluid chamber to separate said inlet ports and movable in said fluid chamber to alternately connect one said inlet port with said coating orifice and seal the other from said coating orifice and connect the other said inlet port of said pair of inlet ports to the coating orifice and seal one inlet port.

2. A die according to claim 1 wherein said cam means comprises an elongate cylindrical body formed to conform and sealingly fit in said means defining a fluid chamber, said cylindrical body having cut-out areas on opposite sides of the axis of the cylindrical body defining a partition to form a pair of manifolds in said fluid chamber on opposite sides of said axis of said cam whereby oscillation of said cam about the axis connect said inlet ports alternately with said coating orifice.

3. A die according to claim 1 wherein a plurality of coating orifices are spaced along said die body and transverse to the path of movement of a web past said die body.

4. A die according to claim 3 wherein said coating orifices are slotted openings and said cam means comprises a member disposed in said fluid chamber and movable with relationship to said slotted openings to connect each slotted opening alternately to a different one of said inlet ports.

5. A die assembly according to claim 4 wherein said die body has a plurality of bypass ports and in said first position of said cam means the second one of said manifolds that is sealed from that coating orifice communicates between said second one of said inlet ports and one of said bypass ports, and in said second position of said cam means the first one of said manifolds that is sealed from that coating orifice comunicates between said first one of said inlet ports and a different one of said bypass ports.

6. A die according to claim 1 including means for defining a pair of outlet ports in said die body wherein said cam means connects said inlet port sealed from said coating orifice to one of said outlet ports.

7. A coating die assembly for coating a web, said die assembly comprising a die body having spaced coating orifices opening through an exterior surface adapted to be positioned adjacent the surface to be coated, having a cavity communicating with said orifices, and having a plurality of spaced inlet ports communicating with said cavity, cam means disposed within said cavity and having spaced recesses for defining with said die body a plurality of manifolds with a different pair of said manifolds adjacent each coating orifice, said cam means being movable relative to said die body between a first position with a first one of said manifolds adjacent each coating orifice communicating between a first one of said inlet ports and that coating orifice and a second one of said manifolds adjacent that coating orifice sealed from that coating orifice, and a second position with the second one of said manifolds adjacent that coating orifice communicating between a second one of said inlet ports and that coating orifice and with said first one of said manifolds sealed from that coating orifice, and means for moving said cam means between said first and second positions.

8. A die assembly according to claim 7 wherein said cam means includes walls forming said manifolds and having land areas closely fitting surfaces of said die body defining said cavity.

* * * * *